US010500449B2

(12) United States Patent
Henrikson et al.

(10) Patent No.: US 10,500,449 B2
(45) **Date of Patent: *Dec. 10, 2019**

(54) GOLF CLUB HEAD WITH OPEN CROWN AND RELATED METHODS

(71) Applicant: KARSTEN MANUFACTURING CORPORATION, Phoenix, AZ (US)

(72) Inventors: Erik M. Henrikson, Phoenix, AZ (US); Eric J. Morales, Laveen, AZ (US); Ryan M. Stokke, Anthem, AZ (US); Eric V. Cole, Phoenix, AZ (US); Cory S. Bacon, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/992,031

(22) Filed: May 29, 2018

(65) Prior Publication Data

US 2018/0272204 A1 Sep. 27, 2018

Related U.S. Application Data

(63) Continuation of application No. 15/349,853, filed on Nov. 11, 2016, now Pat. No. 10,004,955, which is a (Continued)

(51) Int. Cl.
*A63B 53/04* (2015.01)
*A63B 60/54* (2015.01)

(52) U.S. Cl.
CPC ..... *A63B 53/0466* (2013.01); *A63B 53/047* (2013.01); *A63B 60/54* (2015.10); (Continued)

(58) Field of Classification Search
CPC ..... A63B 53/047; A63B 60/54; A63B 2053/0458; A63B 2053/0408; A63B 2053/0454; Y10T 29/49828
See application file for complete search history.

(56) References Cited

U.S. PATENT DOCUMENTS 1,359,220 A 11/1920 Beamer
5,409,229 A 4/1995 Schmidt et al.
(Continued)

FOREIGN PATENT DOCUMENTS

JP 53174655 12/1993

OTHER PUBLICATIONS

PCT International Search Report dated Jul. 27, 2015 from corresponding PCT Application No. PCT/US2015/030076.

*Primary Examiner* — Jeffrey S Vanderveen

(57) ABSTRACT

Described herein is a golf club head devoid of a crown, the club head comprising: a front end having a bottom rail, a top rail, and a strikeface, the strikeface including a striking surface, a back surface, and a reinforcement element extending from the back surface of the strikeface; a rear end opposite the front end; a heel portion; a toe portion opposite the heel potion; a sole coupled to the front end along the bottom rail at a sole transition region, the sole extending toward the rear end of the golf club head and including a sole thickness, at least one weight member, and a perimeter wall extending from the front end near the heel portion to the front end near the toe portion along the rear end of the club head, wherein the perimeter wall decreases in height from the front end toward the rear end of the club head.

15 Claims, 5 Drawing Sheets

Section A-A

Related U.S. Application Data continuation-in-part of application No. 14/920,480, filed on Oct. 22, 2015, and a continuation-in-part of application No. 14/710,236, filed on May 12, 2015.

(60) Provisional application No. 62/254,754, filed on Nov. 13, 2015, provisional application No. 62/206,152, filed on Aug. 17, 2015, provisional application No. 62/146,783, filed on Apr. 13, 2015, provisional application No. 62/131,739, filed on Mar. 11, 2015, provisional application No. 62/105,464, filed on Jan. 20, 2015, provisional application No. 62/105,460, filed on Jan. 20, 2015, provisional application No. 62/101,926, filed on Jan. 9, 2015, provisional application No. 62/068,232, filed on Oct. 24, 2014, provisional application No. 62/023,819, filed on Jul. 11, 2014, provisional application No. 61/994,029, filed on May 15, 2014.

(52) U.S. Cl.
CPC . *A63B 2053/045* (2013.01); *A63B 2053/0408* (2013.01); *A63B 2053/0433* (2013.01); *A63B 2053/0437* (2013.01); *A63B 2053/0454* (2013.01); *A63B 2053/0458* (2013.01); *Y10T 29/49828* (2015.01)

(56) References Cited

U.S. PATENT DOCUMENTS

| | | | | |
|---|---|---|---|---|
| 5,429,354 | A | 7/1995 | Long et al. | |
| 5,518,242 | A | 5/1996 | Mahaffey et al. | |
| 5,586,947 | A | 12/1996 | Hutin | |
| 5,595,552 | A | 1/1997 | Wright et al. | |
| 5,643,099 | A | 7/1997 | Solheim | |
| 5,649,872 | A | 7/1997 | Antonious | |
| 5,695,411 | A | 12/1997 | Wright et al. | |
| 5,722,900 | A | 3/1998 | Sung | |
| 6,319,149 | B1 | 11/2001 | Lee | |
| D470,552 | S | 2/2003 | Cleveland et al. | |
| D470,553 | S | 2/2003 | Helmstetter et al. | |
| 6,530,848 | B2 | 3/2003 | Gillig | |
| 6,616,546 | B2 | 9/2003 | Cho | |
| 6,623,374 | B1 | 9/2003 | Helmstetter et al. | |
| 6,849,005 | B2 | 2/2005 | Rife | |
| 6,997,820 | B2 | 2/2006 | Willett et al. | |
| RE39,178 | E | 7/2006 | Allen | |
| 7,083,530 | B2 | 8/2006 | Wahl et al. | |
| 7,128,660 | B2 | 10/2006 | Gillig | |
| 7,192,364 | B2 | 3/2007 | Long | |
| 7,387,579 | B2 | 6/2008 | Lin et al. | |
| 8,142,308 | B2 | 3/2012 | Gillig | |
| 8,262,495 | B2 | 9/2012 | Stites | |
| 8,535,177 | B1 | 9/2013 | Wahl et al. | |
| 8,657,701 | B2 | 2/2014 | Boyd et al. | |
| 8,690,710 | B2 | 4/2014 | Nicolette et al. | |
| 9,114,293 | B2 | 8/2015 | Soracco | |
| 9,597,562 | B2 | 3/2017 | Dipert et al. | |
| 2002/0183134 | A1 | 12/2002 | Allen et al. | |
| 2007/0015601 | A1* | 1/2007 | Tsunoda | A63B 53/04 473/346 |
| 2008/0004130 | A1* | 1/2008 | Lin | A63B 53/04 473/342 |
| 2009/0029796 | A1 | 1/2009 | Mergy et al. | |
| 2010/0279795 | A1* | 11/2010 | Nicolette | A63B 53/047 473/350 |

* cited by examiner

Section A-A

Section B-B

GOLF CLUB HEAD WITH OPEN CROWN AND RELATED METHODS

CROSS REFERENCE TO RELATED APPLICATIONS

This is a continuation of U.S. patent application Ser. No. 15/349,853, which claims the benefit of U.S. Provisional Patent Appl. No. 62/254,754, filed on Nov. 13, 2015. U.S. patent application Ser. No. 15/349,853 is also a continuation in part of U.S. patent application Ser. No. 14/710,236, filed on May 12, 2015, which claims the benefit of U.S. Provisional Patent Appl. No. 61/994,029, filed on May 15, 2014, U.S. Provisional Patent Appl. No. 62/023,819, filed on Jul. 11, 2014, U.S. Provisional Patent Appl. No. 62/101,926, filed on Jan. 9, 2015, and U.S. Provisional Patent Appl. No. 62/146,783, filed on Apr. 13, 2015. U.S. patent application Ser. No. 15/349,853 is also a continuation in part of U.S. patent application Ser. No. 14/920,480, filed on Oct. 22, 2015 which claims priority to U.S. Provisional Patent Appl. No. 62/206,152, filed on Aug. 17, 2015, U.S. Provisional Patent Appl. No. 62/131,739, filed on Mar. 11, 2015, U.S. Provisional Patent Appl. No. 62/105,460, filed on Jan. 20, 2015, U.S. Provisional Patent Appl. No. 62/105,464, filed on Jan. 20, 2015, and U.S. Provisional Patent Appl. No. 62/068,232, filed on Oct. 24, 2014. The contents of all of the above described are incorporated by reference herein in their entirety.

FIELD OF INVENTION

The present disclosure is related to golf equipment. In particular, the present disclosure relates to a golf club head devoid of a crown.

BACKGROUND

Golf clubs take various forms, for example a wood, a hybrid, an iron, a wedge, or a putter, and these clubs generally differ in head shape and design, club head material (s), shaft material(s), club length, and club loft, to achieve different performance characteristics.

Woods and hybrids typically have low loft to maximize distance, and hollow club head bodies to achieve a high moment of inertia to maintain directional accuracy. Conversely, irons typically have higher lofts designed for distance accuracy, and to assist a ball in stopping on the green. While golf clubs have a variety of known designs, there is a need in the art for a golf club designed to achieve distance, similar to a wood and/or hybrid, while maintaining a high launch angle, similar to an iron.

Figure 1:
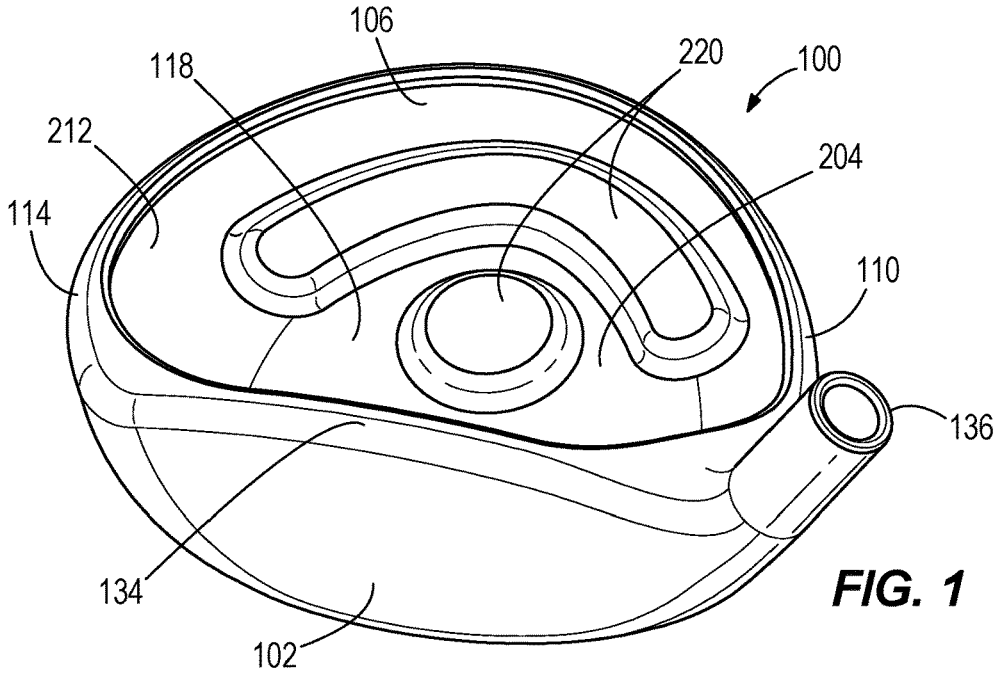
FIG. 1 illustrates a front perspective view of a golf club head.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a golf club head devoid of a crown. The golf club head includes a front end, a rear end opposite the front end, a heel portion, a toe portion opposite the heel portion, and a sole. The sole of the club head is coupled to a bottom rail of the front end of the club head defining a sole transition. The sole transition includes a sole transition thickness that is minimized to allow increased bending of the strikeface. Increased bending of the strikeface can reduce energy loss of the ball on impact, thereby increasing ball speed and distance. The club head further includes at least one weight member positioned to shift the head center of gravity (CG) toward the rear end and sole, and to increase the moment of inertia of the club head. Low and back head CG, resulting from the lack of crown and the weight member position, can result in reduced backspin and increased dynamic loft of the club head, thereby increasing travel distance. Increased moment of inertia results in increased forgiveness for off center hits of the golf club with a golf ball.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The term "ground plane" refers to a plane is positioned at a 60 degree angle to a hosel axis of a golf club head with respect to a front view, and perpendicular to the hosel axis of the golf club head with respect to a side view. Further, the term "front plane" refers to a plane that is tangential to a leading edge point when viewed from a side view, while also perpendicular to a ground plane.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIGS. 1-8 illustrate a golf club head 100 according to an embodiment. The golf club head 100 includes a front end 102, a rear end 106 opposite the front end 102, a heel portion 110, a toe portion 114 opposite the heel portion 110, and a sole 118. The front end 102 of the golf club 100 includes a bottom rail 130 and a top rail 134, both the bottom rail 130 and top rail 134 extending from the heel portion 110 to the toe portion 114 of the club head 100. The front end 102 of the club head 100 further includes a strikeface 160, the strikeface 160 having a striking surface 164, a back surface 168, a perimeter 176, and a geometric center 172. In many embodiments, the back surface 168 of the strikeface 160 is exposed or visible when viewing the club head 100. Further, in many embodiments, the club head 100 described herein is devoid of a crown.

In many embodiments, the golf club head can be a wood or hybrid type golf club head. In these embodiments, the golf club head can have a volume within the range of 100 cc to 500 cc. For example, the golf club head can have a volume greater than 100 cc, greater than 150 cc, greater than 200 cc, greater than 250 cc, greater than 300 cc, greater than 350 cc, greater than 400 cc, or greater than 450 cc. For further example, the volume of the golf club head can be 200 cc, 250 cc, 300 cc, 350 cc, 400 cc, 450 cc, or 500 cc. Further, in these embodiments, the golf club head can have a loft within the range of 5 degrees to 40 degrees. For example, the loft of the golf club head can be less than 40 degrees, less than 35 degrees, less than 30 degrees, less than 25 degrees, less than 20 degrees, less than 15 degrees, or less than 10 degrees. For further example, the loft of the golf club head can be 5 degrees, 10 degrees, 15 degrees, 20 degrees, 25 degrees, 30 degrees, 35 degrees, or 40 degrees.

In other embodiments, the golf club head can be an iron type golf club head. In these embodiments, the golf club head can have a volume within the range of 10 cc to 150 cc. For example, the volume of the golf club head can be less than 150 cc, less than 125 cc, less than 100 cc, less than 90 cc, less than 80 cc, less than 70 cc, less than 60 cc, less than 50 cc, or less than 40 cc. For further example, the volume of the golf club head can be 10 cc, 20 cc, 30 cc, 40 cc, 50 cc, 60 cc, 70 cc, 80 cc, 90 cc, or 100 cc. Further, in these embodiments, the club head can have a loft within the range of 10 degrees to 80 degrees. For example, the loft of the club head can be greater than 10 degrees, greater than 20 degrees, greater than 30 degrees, greater than 40 degrees, greater than 50 degrees, greater than 60 degrees, or greater than 70 degrees. For further example, the golf club head can have a loft of 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 75 degrees, or 80 degrees.

The club head 100 described herein can be part of a golf club (not shown). The golf club includes the club head 100, a shaft, and a grip. The club head 100 can be coupled to a first end of the shaft, and the grip can be coupled to a second end of the shaft to form the golf club. In the illustrated embodiment, the club head 100 includes a hosel 136 configured to receive the first end of the shaft. In other embodiments, the club head 100 can be coupled to the first end of the shaft without the use of the hosel 136. The hosel 136 includes a hosel axis 1009 extending centrally through a bore in the hosel.

Figure 2:
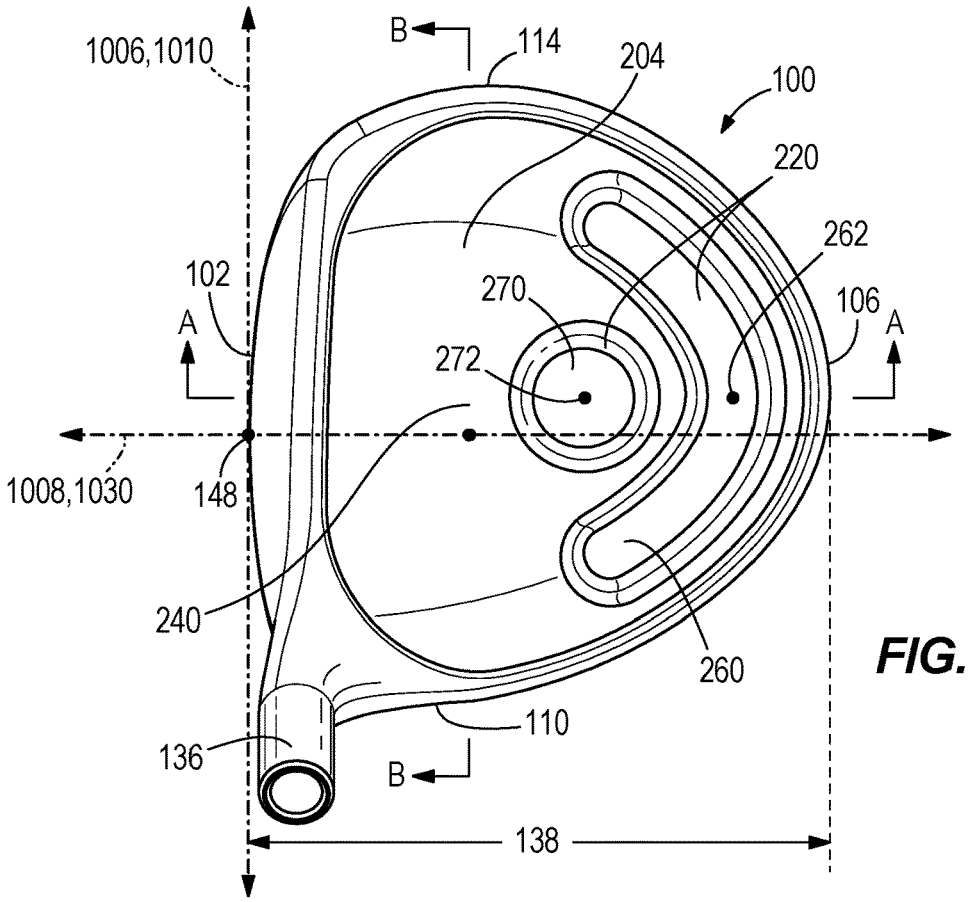
FIG. 2 illustrates a top view of the golf club head in FIG. 1.
Figure 3:
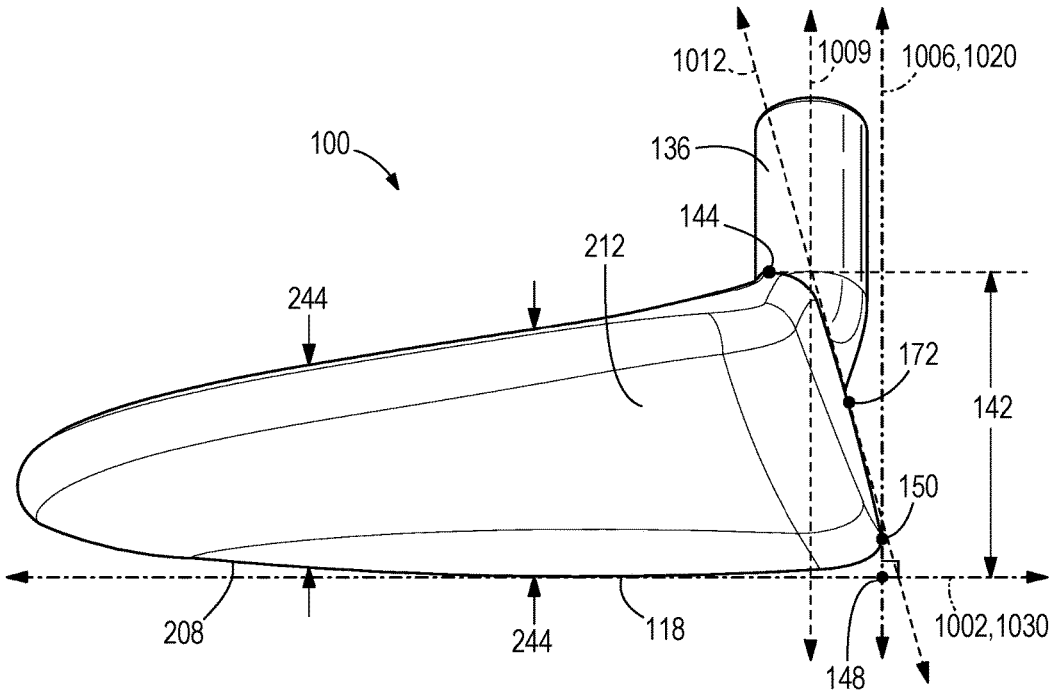
FIG. 3 illustrates a front view of the golf club head in FIG. 1.
Figure 4:
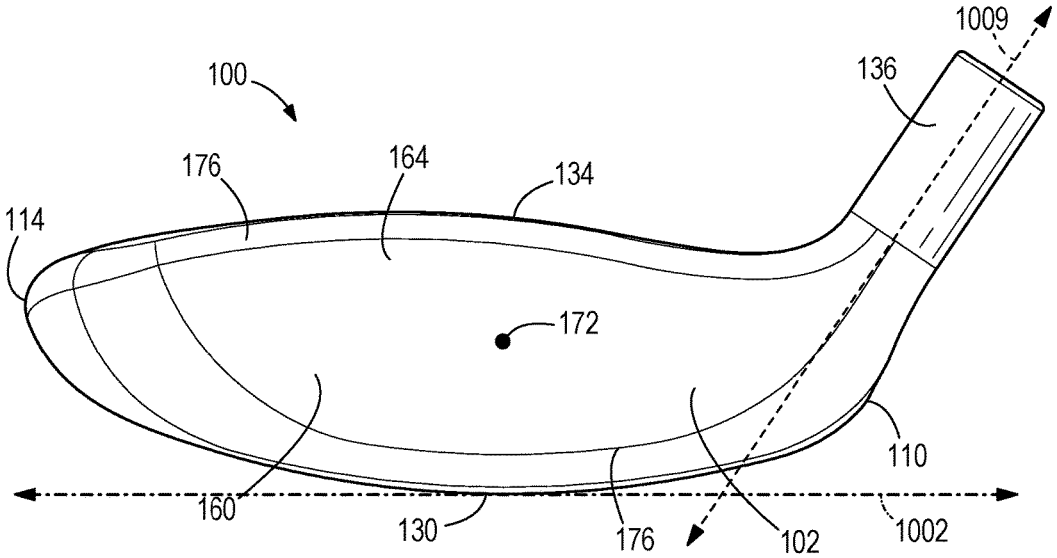
FIG. 4 illustrates a side view of the golf club head in FIG. 1.
Figure 5:
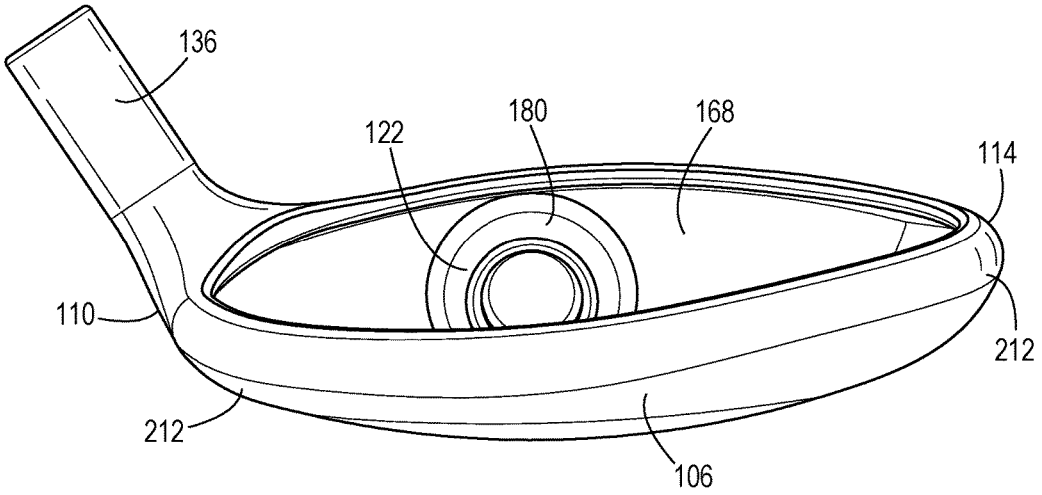
FIG. 5 illustrates a back perspective view of the golf club head in FIG. 1.

Referring to FIGS. 1-2, the club head 100 further includes a length 138, a height 142, and a head center of gravity (CG) 146. The head CG position can be described with reference to a loft plane 1012, a ground plane 1002, and a front plane 1006. The loft plane 1012 is tangential to the geometric center 172 of the strikeface 160. The ground plane 1002 is positioned at a 60 degree angle to the hosel axis 1009 with respect to a front view of the club head 100 (FIG. 4) and is perpendicular to the hosel axis 1009 with respect to a side view of the club head 100 (specifically, FIG. 3). Further, the front plane 1006 is tangential to a leading edge point 150 on the club head 100 with respect to a side view (FIG. 3), while also perpendicular to the ground plane 1002. In these embodiments, an angle between the loft plane 1012 and the front plane 1006 is the same as a loft angle between the loft plane 1012 and the hosel axis 1009 in the side view of the club head (FIG. 3).

A head CG plane 1008 extends perpendicular to the ground plane 1002 and the front plane 1006 through the head CG 146. The point of intersection of the ground plane 1002, the front plane 1006, and the head CG plane 1008 defines an origin of a coordinate system 148 having an x-axis, a y-axis, and a z-axis. The x-axis 1010 extends through the origin 148 in a direction from the heel portion 110 to the toe portion 114, parallel to the ground plane 1002. The y-axis 1020 extends through the origin 148 in a direction from the bottom rail 130 to the top rail 134 of the front end 102, perpendicular to the ground plane 1002. The z-axis 1030 extends through the origin 148 in a direction from the front end 102 to the rear end 106 of the club head 100 parallel to the ground plane 1002. The head CG 146 is positioned at a head CG height 152 from the ground plane 1002, measured in the direction of the y-axis 1020. The head CG 146 is further positioned at a head CG depth 156 from the front plane 1006, measured in the direction of the z-axis 1030.

Referring to FIG. 2, the length 138 of the club head 100 is measured as the greatest distance from the front plane 1006 to the rear end 106 of the club head 100 in the direction of the z-axis 1030. In many embodiments, the length 138 of the club head can be greater than 1.5 inches (3.81 cm), greater than 1.75 inches (4.45 cm), greater than 2.0 inches (5.08 cm), greater than 2.25 inches (5.72 cm), greater than 2.5 inches (6.35 cm), greater than 2.75 inches (6.99 cm), greater than 3.0 inches (7.62 cm), greater than 3.25 inches (8.26 cm), greater than 3.5 inches (8.89 cm), greater than 3.75 inches (9.53 cm), greater than 4.0 inches (10.16 cm), greater than 4.25 inches (10.80 cm), or greater than 4.5 inches (11.43 cm). In many embodiments, the length 138 of the club head 100 is approximately 3.0-4.8 inches (7.62-

12.19 cm). In some embodiments, the length 138 of the club head 100 can be approximately 3.5-4.5 inches (8.89-11.43 cm). For example, the length 138 of the club head 100 can be approximately 3.5 inches (8.89 cm), approximately 3.6 inches (9.14 cm), approximately 3.7 inches (9.40 cm), approximately 3.8 inches (9.65 cm), approximately 3.9 inches (9.91 cm), approximately 4.0 inches (10.16 cm), approximately 4.1 inches (10.41 cm), approximately 4.2 inches (10.67 cm), approximately 4.3 inches (10.92 cm), approximately 4.4 inches (11.18 cm), or approximately 4.5 inches (11.43 cm). In the illustrated embodiment, the length 138 of the club head 100 is approximately 3.9 inches (9.91 cm).

Referring to FIG. 3, the height 142 of the club head 100 is measured as the greatest distance from the ground plane 1002 to a highest point 144 of the front end 102 in the direction of the y-axis 1020. In many embodiments, the height 142 of the club head 100 is approximately 1.0-2.0 inches (2.54-5.08 cm). In some embodiments, the height 142 of the club head 100 can be approximately 1.2-1.6 inches (3.05-4.06 cm). For example, the height 142 of the club head 100 can be approximately 1.0 inches (2.54 cm), approximately 1.1 inches (2.79 cm), approximately 1.2 inches (3.05 cm), approximately 1.3 inches (3.30 cm), approximately 1.4 inches (3.56 cm), approximately 1.5 inches (3.81 cm), approximately 1.6 inches (4.06 cm), approximately 1.7 inches (4.32 cm), approximately 1.8 inches (4.57 cm), approximately 1.9 inches (4.83 cm), or approximately 2.0 inches (5.08 cm). In the illustrated embodiment, the height 142 of the club head 100 is approximately 1.36 inches (3.45 cm).

The club head 100 described herein can comprise any material or combination of materials. For example, the club head 100 can comprise a metal (e.g. titanium or steel), a metal alloy (e.g. titanium alloy, steel alloy, stainless steel alloy), or a composite material. In some embodiments, the club head 100 can comprise 17-4 stainless steel. In some embodiments, the club head 100 can comprise H900 stainless steel. In some embodiments, the club head 100 can comprise a titanium alloy such as Ti-6-4 or Ti-9s. In other embodiments, the club head 100 can comprise any other material.

The club head 100 described herein is devoid of a crown. The lack of a crown on the club head 100 allows the head CG 146 to be positioned closer to the sole 118 of the club head 100 than a similar club head having a crown. Further, the lack of a crown on the club head 100 allows the head CG 146 to be positioned closer to the rear end 106 of the club head 100 than a similar club head having a crown. The head CG 146 is positioned closer to the sole 118 and/or rear end 106 of the club head 100 due to reduced material weight on the top and front of the club head 100, as is typically present on golf club heads having crowns. In many embodiments, the head CG height 152 of the club head 100 without a crown is less than the head CG height of a similar club head with a crown. Further, in many embodiments, the head CG depth 156 of the club head 100 without a crown is greater than the head CG depth of a similar club head with a crown.

Positioning of the head CG 146 closer to the rear end 106 of the club head 100 can increase the moment of inertia of the club head 100, resulting in increased forgiveness for off center hits. Positioning of the head CG 146 closer to the sole 118 of the club head 100 can reduce backspin on a golf ball on impact with the club head 100. Reduced backspin can decrease the height of the golf ball's trajectory, thereby increasing travel distance. Accordingly, the club head 100 devoid of the crown can have increased forgiveness for off center hits, and increased ball travel distance, compared to a similar golf club head 100 with a crown.

In the illustrated embodiment, the head CG height 152 is approximately 0.55 inch (1.40 cm). In many embodiments, the head CG height 152 is approximately 0.10-0.90 inch (0.25-2.29 cm). In some embodiments, the head CG height 152 can be approximately 0.25-0.75 inch (0.64-1.91 cm). For example, the head CG height 152 can be less than approximately 0.10 inch (0.25 cm), less than approximately 0.20 inch (0.51 cm), less than approximately 0.30 inch (0.76 cm), less than approximately 0.40 inch (1.02 cm), less than approximately 0.50 inch (1.27 cm), less than approximately 0.60 inch (1.52 cm), less than approximately 0.70 inch (1.78 cm), less than approximately 0.80 inch (2.03 cm), or less than approximately 0.90 inch (2.29 cm). The head CG height 152 can also be described with reference to the height 142 of the club head 100. In the illustrated embodiment, the head CG height 152 is approximately 40% of the height 142 of the club head 100. In many embodiments, the head CG height 152 is approximately 20-60% of the height 142 of the club head 100. In some embodiments, the head CG height 152 is approximately 30-50% of the height 142 of the club head 100. For example, the head CG height 152 can be less than approximately 60%, less than approximately 55%, less than approximately 50%, less than approximately 45%, less than approximately 40%, less than approximately 35%, less than approximately 30%, or less than approximately 25% of the height 142 of the club head 100.

In the illustrated embodiment, the head CG depth 156 is approximately 1.3 inches (3.30 cm). In many embodiments, the head CG depth 156 is approximately 1.0-2.5 inches (2.54-6.35 cm). In some embodiments, the head CG depth 156 can be approximately 1.25-1.75 inches (3.18-4.45 cm). For example, the head CG depth 156 can be greater than approximately 1.0 inch (2.54 cm), greater than approximately 1.25 inches (3.18 cm), greater than approximately 1.50 inches (3.81 cm), greater than approximately 1.75 inches (4.45 cm), greater than approximately 2.00 inches (5.08 cm), greater than approximately 2.25 inches (5.72 cm), or greater than approximately 2.75 inches (6.70 cm). The head CG depth 156 can also be described with reference to the length 136 of the club head 100. In the illustrated embodiment, the head CG depth 156 is approximately 33% of the length 136 of the club head 100. In many embodiments, the head CG depth 156 is approximately 25-50% of the length 136 of the club head 100. In some embodiments, the head CG depth 156 is approximately 30-40% of the length 136 of the club head 100. For example, the head CG depth 156 can be greater than approximately 25%, greater than approximately 30%, greater than approximately 35%, greater than approximately 40%, or greater than approximately 45% of the length 136 of the club head 100.

In many embodiments, the club head 100 further includes a reinforcement element 180 on the back surface 168 of the strikeface 160. The reinforcement element 180 may be similar to the reinforcement element described in U.S. patent application Ser. No. 14/710,236, entitled "Club Heads Having Reinforced Club Head Faces and Related Methods." For example, the reinforcement element 180 can be one or more looped rib(s) positioned about the geometric center 172 on the back surface 168 of the strikeface 160. In the illustrated embodiment, the reinforcement element 180 is substantially circular. In other embodiments, the reinforcement element 180 can have any other shape. For example, the reinforcement element 180 can be elliptical, rectangular, trapezoidal, or any other shape or combination of shapes.

In many embodiments, the looped rib comprises an inner perimeter surface and an outer perimeter surface, wherein at least one of the inner perimeter surface or the outer perimeter surface is filleted with the back surface 168 of the strikeface 160. In many embodiments, filleting the outer perimeter surface with the back surface 168 of the strikeface 160 redistributes impact stresses over a greater area, thereby allowing the strikeface 160 and/or club head 100 to store greater impact energy for increased energy transfer to a golf ball. Increasing energy transfer to a golf ball can beneficially increase ball speed and travel distance.

Further, in many embodiments, the inner perimeter surface of the reinforcement element 180 comprises a largest rib span. The largest rib span 538 can refer to the largest distance from one side of the inner perimeter surface 129 across to an opposing side of the inner perimeter surface 129, measured parallel to the back surface 168. Accordingly, when the looped rib 122 comprises an elliptical looped rib, the largest rib span 538 can refer to a major axis of inner perimeter surface 129. Further, when the looped rib 122 comprises a circular looped rib, the largest rib span 538 can refer to a diameter of inner perimeter surface 129. Notably, in many embodiments, the largest rib span 538 can be measured at a midpoint of the inner perimeter surface 129. In some embodiments, the largest rib span 538 can be approximately 0.609 cm to approximately 1.88 cm. In some embodiments, largest rib span 538 can be approximately 1.0 cm.

Further, the looped rib 122 can comprise a rib thickness 539. The rib thickness 539 can refer to a distance between the inner perimeter surface 129 and the outer perimeter surface 128 of looped rib 122, measured parallel to the back surface 168. In some embodiments, the thickness of the looped rib 122 can vary throughout the looped rib 122, and the rib thickness 539 can be a maximum rib thickness of looped rib 122. In many embodiments, the rib thickness 539 can be approximately 0.050 cm to approximately 1.50 cm. In some embodiments, the rib thickness 539 can be approximately 0.05 cm. In some embodiments, the rib thickness 539 can be greater than or equal to approximately 0.25 centimeters. In some embodiments, the rib thickness 539 can be approximately 0.50 centimeters. In some embodiments, the rib thickness 539 can be approximately 0.75 centimeters. In some embodiments, the rib thickness 539 can be approximately 1.00 centimeters. In some embodiments, the rib thickness 539 can be approximately 1.25 centimeters. In some embodiments, the rib thickness 539 can be approximately 1.50 centimeters. In various embodiments, when the looped rib(s) 122 comprises multiple looped ribs, two or more looped ribs can comprise the same rib thicknesses, and/or two or more looped ribs can comprise different rib thicknesses.

Further still, the looped rib 122 can comprise a rib height 540. The rib height 540 can refer to a distance perpendicular from the back surface 168 to a location of the looped rib 122 farthest from the back surface 168 (i.e., also defined as the interface of the outer perimeter surface 128 with the inner perimeter surface 129). In these or other embodiments, the rib height 540 can be greater than or equal to approximately 0.3048 centimeters. In some embodiments, the rib height 540 can be approximately 0.1778 cm to approximately 0.3048 cm. In some embodiments, the rib height 540 can be approximately 0.17 cm, 0.20 cm, 0.23 cm, 0.26 cm, 0.29 cm, or 0.30 cm. In many embodiments, the rib height 540 can be less than or equal to approximately 0.512 cm. In some embodiments, the height of the looped rib 122 can vary throughout the looped rib 122, and the rib height 540 can be a maximum rib height of looped rib 122. In various embodiments, when looped rib(s) comprises multiple looped ribs, two or more looped ribs can comprise the same rib heights, and/or two or more looped ribs can comprise different rib heights.

The reinforcement element 180 is positioned on the back surface 168 of the strikeface 160 such that the strikeface 160 has a variable thickness profile. The thickness profile of the strikeface 160 includes a nominal thickness 184 near the geometric center 172 of the strikeface 160. When moving from the geometric center 172 toward the perimeter 176 of the strikeface 160, the thickness profile increases from the nominal thickness 184 to a maximum thickness 188, then decreases or returns to the nominal thickness 184. In the illustrated embodiment, the thickness profile increases as a step, then decreases gradually along a fillet when moving from the geometric center 172 toward the perimeter 176 of the strikeface 160.

In other embodiments, the thickness profile can increase or decrease from the geometric center 172 to the perimeter 176 of the strikeface 160 according to any profile. For example, the thickness profile can increase or decrease as a step, or in a linear or non-linear (e.g. quadratic, parabolic, exponential) capacity. Further, the thickness profile can increase and decrease according to the same profile, or the thickness profile can increase and decrease according to different profiles.

In the illustrated embodiment, the nominal thickness 184 of the strikeface 160 is approximately 0.085 inch (0.22 cm). In many embodiments, the nominal thickness 184 of the strikeface 160 is approximately 0.060-0.10 inch (0.15-0.25 cm). In some embodiments, the nominal thickness 184 of the strikeface 160 can be approximately 0.07-0.90 inch (0.18-2.29 cm). For example, the nominal thickness 184 of the strikeface can be less than or equal to approximately 0.10 inch (0.25 cm), less than or equal to approximately 0.095 inch (0.24 cm), less than or equal to approximately 0.090 inch (0.23 cm), less than or equal to approximately 0.085 inch (0.22 cm), less than or equal to approximately 0.080 inch (0.20 cm), less than or equal to approximately 0.075 inch (0.19 cm), or less than or equal to 0.070 inch (0.18 cm).

In many embodiments, the maximum thickness 188 of the strikeface 160 is approximately 0.150-0.350 inch (0.38-0.89 cm). In some embodiments, the maximum thickness 188 of the strikeface 160 can be approximately 0.20-0.30 inch (0.51-0.76 cm). For example, the maximum thickness 188 of the strikeface 160 can be approximately 0.20 inch (0.51 cm), approximately 0.22 inch (0.56 cm), approximately 0.24 inch (0.61 cm), approximately 0.26 inch (0.66 cm), approximately 0.28 inch (0.71 cm), or approximately 0.30 inch (0.76 cm). In the illustrated embodiment, the maximum thickness 188 of the strikeface 160 is approximately 0.235 inch (0.60 cm).

The reinforcement element 180 described herein is configured to reinforce the strikeface 160, while allowing the strikeface 160 to bend on impact with a golf ball, thereby allowing the nominal thickness 184 of the strikeface 160 to be reduced. Reducing the nominal thickness 184 of the strikeface 160 results in weight savings that can be advantageously redistributed as discretionary mass to other parts of the club head 100. Redistributing discretionary mass to other parts of the club head 100 can optimize the head CG 146 position of the club head 100 to improve club head 100 performance characteristics (e.g. reducing backspin or increasing dynamic loft). Further, redistributing discretionary mass to other parts of the club head 100 can further increase the moment of inertia of the club head 100, thereby increasing club head 100 forgiveness for off center hits.

Figure 6:
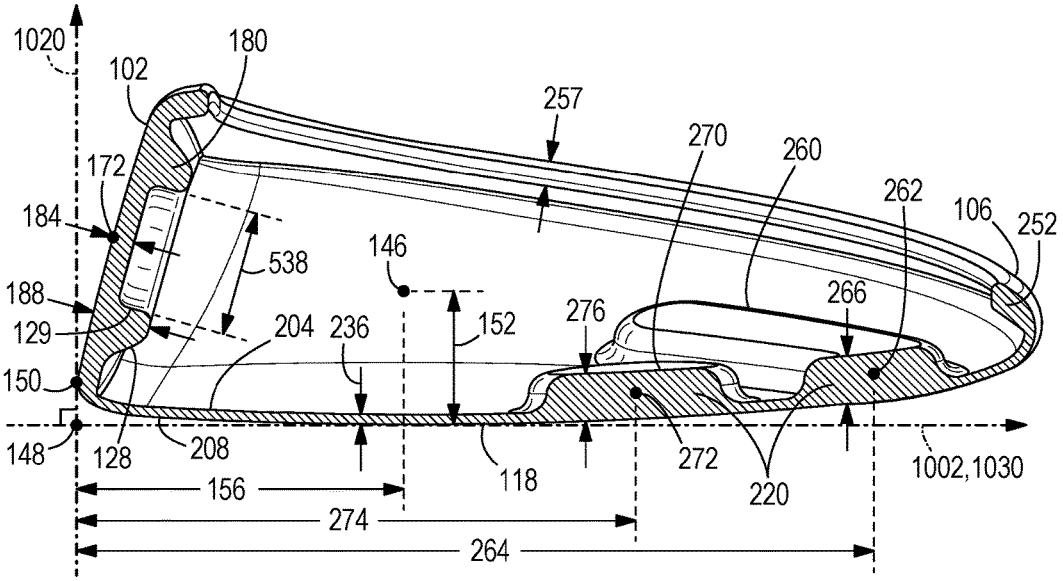
FIG. 6 illustrates a cross sectional view along line A-A of the golf club head in FIG. 2.
Figure 7:
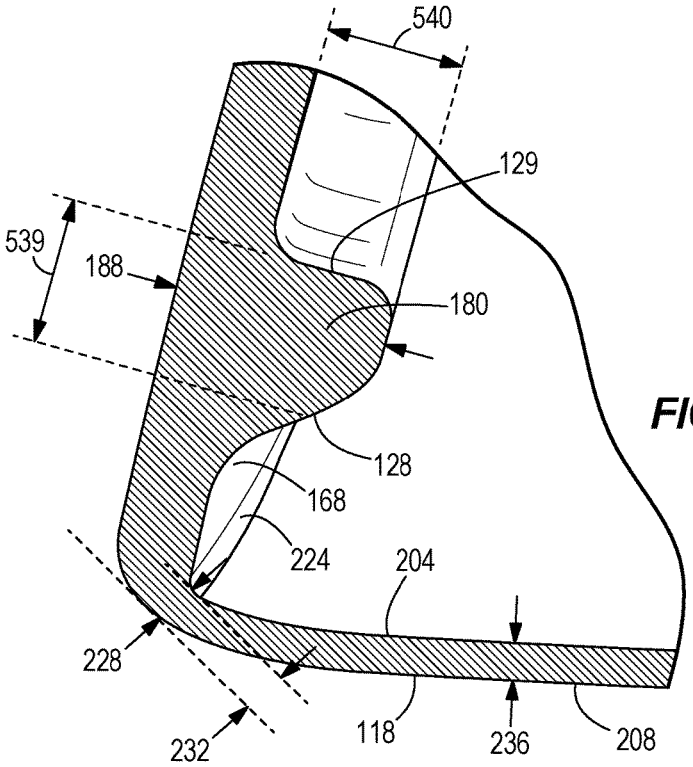
FIG. 7 illustrates an enlarged cross sectional view of the golf club head in FIG. 6.
Figure 8:
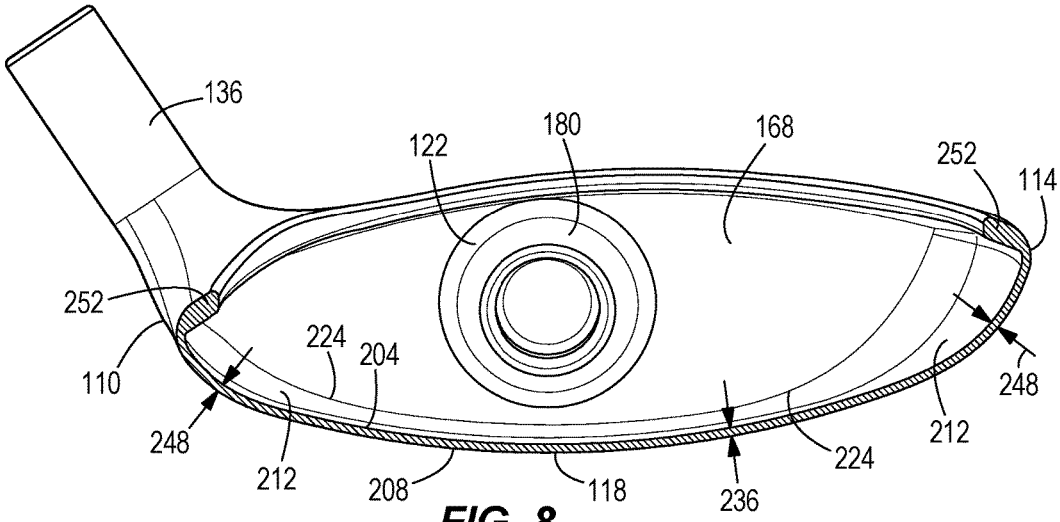
FIG. 8 illustrates a cross sectional view along line B-B of the golf club head in FIG. 2

Referring to FIGS. 6-8, the sole 118 of the club head 100 includes a top surface 204, a bottom surface 208, a perimeter wall 212, and a weight member or plurality of weight members 220 (FIG. 2). In many embodiments, the top surface 204 of the sole 118 is exposed or visible when viewing the club head 100.

The sole 118 is coupled to the front end 102 of the club head 100 and extends from the front end 102 to the rear end 106 of the club head 100. The sole 118 is coupled to the front end 102 of the club head 100 along the bottom rail 130, defining a sole transition region 224 extending from the heel portion 110 to the toe portion 114.

In the illustrated embodiment, the sole transition region 224 includes a radius of curvature 228 and a sole transition thickness 232 measured at the radius of curvature 228 of the sole transition region 224 between an inner surface and an outer surface of the club head 100. The radius of curvature 228 of the sole transition region 224 is approximately 0.020 inch (0.051 cm). In many embodiments, the radius of curvature 228 of the sole transition region 224 is approximately 0.010-0.040 inch (0.025-0.102 cm). In some embodiments, the radius of curvature 228 of the sole transition region 224 can be approximately 0.010-0.030 inch (0.025-0.076 cm). For example, the radius of curvature 228 of the sole transition region 224 can be approximately 0.010 inch (0.025 cm), approximately 0.015 inch (0.038 cm), approximately 0.020 inch (0.051 cm), approximately 0.025 inch (0.064 cm), or approximately 0.030 inch (0.076 cm).

In the illustrated embodiment, the sole transition thickness 232 is approximately 0.040 inch (0.102 cm). In many embodiments, the sole transition thickness 232 is approximately 0.020-0.060 inch (0.051-0.152 cm). In some embodiments, the sole transition thickness 232 can be approximately 0.030-0.050 inch (0.076-0.127 cm). For example, in some embodiments, the sole transition thickness 232 is less than approximately 0.060 inch (0.152 cm), less than approximately 0.055 inch (0.140 cm), less than approximately 0.050 inch (0.127 cm), less than approximately 0.045 inch (0.114 cm), or less than approximately 0.040 inch (0.102 cm) to maximize deflection of the strikeface 160 on impact with a golf ball, thereby increase energy transfer to the ball resulting in increased ball speed and distance. For further example, in some embodiments, the sole transition thickness 232 is greater than approximately 0.020 inch (0.51 cm), greater than approximately 0.025 inch (0.64 cm), or greater than approximately 0.030 inch (0.76 cm) to provide the support necessary to prevent buckling of the club head 100 at the sole transition region 224 due to repeated impact with a golf ball.

In many embodiments, the sole transition thickness 232 is substantially constant from the heel portion 110 to the toe portion 114. In some embodiments, the sole transition thickness 232 may vary from the heel portion 110 to the toe portion 114. For example, the sole transition thickness 232 may be greatest toward the center of the bottom rail 130 and gradually decrease moving toward the heel portion 110 and/or the toe portion 114. For further example, the sole transition thickness 232 may be greatest at the heel portion 110 and/or toe portion 114, and gradually decrease moving toward the center of the bottom rail 130. In these embodiments, the sole transition thickness 232 may increase or decrease in any capacity, such as, for example, linear or nonlinear.

In the illustrated embodiment, the sole transition region 224 includes the radius of curvature 228 and the sole transition thickness 232, as described above. In other embodiments, the sole transition region 224 can include a cascading sole (not shown) instead of, or in addition to the radius of curvature 228 and the sole transition thickness 232. The cascading sole can be similar to the cascading sole described in U.S. patent application Ser. No. 14/920,480, entitled "Golf Club Heads with Energy Storage Characteristics", which is incorporated herein by reference. For example, the sole transition region 224 can include an internal radius transition having at least two tiers or levels of thickness. In some embodiments, the internal radius transition can include a first tier directly adjacent to the strikeface, a second tier directly adjacent to the first tier, and a third tier directly adjacent to the second tier. In these embodiments, the first tier can comprise a first substantially constant thickness, the second tier can comprise a second substantially constant thickness smaller than the first substantially constant thickness, and the third tier can comprise a third substantially constant thickness smaller than the second substantially constant thickness. In many embodiments, the internal radius transition can provide increased bending of the strikeface. Further, in many embodiments, the internal radius transition can more evenly distribute the stresses on the club head 100 on impact with a golf ball.

In the illustrated embodiment, the sole transition thickness 232 is minimized or reduced, while maintaining sufficient thickness to prevent failure. Minimizing or reducing the sole transition thickness 232 allows for maximum or increased deflection of the strikeface 160 on impact with a golf ball. In many embodiments, the club head 100 described herein experiences increased strikeface 160 deflection due to the lack of crown, the minimized or reduced sole transition thickness 232, or a combination of the lack of crown and the minimized or reduced sole transition thickness 232.

Increased deflection of the strikeface 160 can allow the front end 102 of the club head 100 to operate similar to a springboard. When the golf club head 100 hits a golf ball, the ball compresses and energy is lost. The compression and recovery rate of the ball may be associated with a natural frequency. If the strikeface 160 deflects at a natural frequency close to the natural frequency of the golf ball, the deflection of the strikeface 160 may compensate for some of the energy lost when the ball deforms. Increasing the deflection of the strikeface 160 may reduce the deformation of the ball on impact with the club head 100, which may improve the energy retention for the ball after impact, and therefore increase the coefficient of restitution. Increased coefficient of restitution of the club head 100 can result in increased ball speed and distance. Accordingly, the golf club head 100 described herein can experience increased strikeface 160 deflection resulting in increased ball speed and distance, compared to a similar club head having a crown and/or a sole transition with a greater sole transition thickness.

Referring to FIGS. 6-8, the sole 118 further includes a sole thickness or average sole thickness 236, measured from the top surface 204 to the bottom surface 208 of the sole 118. In many embodiments, the sole thickness 236 is approximately constant from the front end 102 to the rear end 106 and from the heel portion 110 to the toe portion 114 of the club head 100. In some embodiments, the sole thickness 236 may vary from the front end 102 toward the rear end 106 and/or from the heel portion 110 to the toe portion 114 of the club head 100.

For example, in some embodiments, the sole thickness 236 can increase from front end 102 toward the rear end 106 of the club head 100. For further example, the sole thickness 236 may increase from a center portion 240 of the sole 118 toward the perimeter wall 212. In these embodiments, increasing the sole thickness 236 from the front end 102 toward the rear end 106 of the club head 100 can position the head CG 146 closer to the sole 118 and/or rear end 106 of the club head 100, thereby reducing backspin and increasing dynamic loft of the club head 100. Further, in these embodiments, increasing the sole thickness 236 from the front end 102 toward the rear end 106 of the club head 100, and/or increasing the sole thickness 236 from the center portion 240 toward the perimeter wall 212 can increase perimeter weighting and therefore increase the moment of inertia of the club head 100, resulting in increased forgiveness of the club head 100.

In the illustrated embodiment, the sole thickness 236 is approximately 0.040 inch (0.102 cm). In many embodiments, the sole thickness 236 is approximately 0.020-0.060 inch (0.051-0.152 cm). In some embodiments, the sole thickness 236 can be approximately 0.030-0.050 inch (0.076-0.127 cm). For example, the sole thickness 236 can be approximately 0.020 inch (0.051 cm), approximately 0.025 inch (0.635 cm), approximately 0.030 inch (0.076 cm), approximately 0.035 inch (0.889 cm), approximately 0.040 inch (0.102 cm), approximately 0.045 inch (0.114 cm), approximately 0.050 inch (0.127 cm), approximately 0.055 inch (0.140 cm), or approximately 0.060 inch (0.152 cm).

Referring to FIGS. 1-3, the perimeter wall 212 of the sole 118 extends from the front end 102 near the heel portion 110 to the front end 102 near the toe portion 114 along the rear end 106 of the club head 100. The perimeter wall 212 includes a perimeter wall height 244 and a perimeter wall thickness 248. In many embodiments, the perimeter wall height 244 decreases from the front end 102 to the rear end 106 of the club head 100. The perimeter wall height 244 may decrease according to any profile from the front end 102 to the rear end 106 of the club head 100. For example, the perimeter wall height 244 may decrease in a linear or non-linear (e.g. exponential, parabolic, or quadratic) capacity.

In the illustrated embodiment, the perimeter wall thickness 248 is substantially constant near the heel portion 110, the toe portion 114, and the rear portion of the club head 100, and gradually increases near the front end 102 of the club head 100. In other embodiments, the perimeter wall thickness 248 may be substantially constant, or the perimeter wall thickness 248 may vary. In some embodiments, the perimeter wall thickness 248 can increase in a direction from at least one of: away from the sole 118, toward the sole 118, toward the front end 102, toward the rear end 106, or a combination of the described directions. For example, the perimeter wall thickness 248 can increase from the front end 102 to the rear end 106 of the club head 100, the perimeter wall thickness 248 can decrease from the front end 102 to the rear end 106 of the club head 100, or the perimeter wall thickness 248 can have a maximum perimeter wall thickness at any location or plurality of locations from the front end 102 of the club head 100.

In the illustrated embodiment, the perimeter wall thickness 248 is approximately 0.040 inch (0.102 cm) near the heel portion 110, the toe portion 114, and the rear portion. Further, in the illustrated embodiment, the perimeter wall thickness 248 is approximately 0.085 inch (0.216 cm) near the front end 102 of the club head 100. In many embodiments the perimeter wall thickness 248 can range from approximately 0.020-0.100 inch (0.051-0.254 cm). Further, in other embodiments, the perimeter wall thickness 248 can range from approximately 0.030-0.090 inch (0.076-0.229 cm). Further still, in many embodiments, the perimeter wall thickness 248 can range from approximately 0.040-0.085 inch (0.102-0.216 cm). In some embodiments, the perimeter wall thickness 248 can be less than approximately 0.10 inch (0.254 cm), less than approximately 0.090 inch (0.229 cm), less than approximately 0.080 inch (0.203 cm), less than approximately 0.070 inch (0.178 cm), less than approximately 0.060 inch (0.152 cm), or less than approximately 0.050 inch (0.127 cm) to reduce the weight of the club head 100, thereby saving weight to be advantageously positioned on other parts of the club head 100 to achieve a desired head CG 146 position or moment of inertia.

In many embodiments, minimizing the sole transition thickness 232, the sole thickness 236, and/or the perimeter wall thickness 248 can result in weight savings that can be advantageously redistributed as discretionary mass to other parts of the club head 100. Redistributing discretionary mass to other parts of the club head 100 can optimize the head CG 146 position of the club head 100 to improve club head 100 performance characteristics (e.g. reducing backspin or increasing dynamic loft). Further, redistributing discretionary mass to other parts of the club head 100 can further increase the moment of inertia of the club head 100, thereby increasing club head 100 forgiveness for off center hits. In many embodiments, the discretionary mass resulting from weight savings due to the lack of crown, the reduced sole transition thickness 232, the reduced sole thickness 236, and/or the reduced perimeter wall thickness 248 is redistributed to the weight member or plurality of weight members 220 of the club head 100.

Referring to FIGS. 6-8, in some embodiments, the perimeter wall 212 may include a lip 252. In many embodiments, the lip 252 can extend along the perimeter wall 212 from the front end 102 near the heel portion 110 to the front end 102 near the toe portion 114 along the rear end 106 of the club head 100. In some embodiments, the lip 252 can extend along the entire perimeter wall 212. In some embodiments, the lip 252 can extend along one or more portions of the perimeter wall 212. For example, the perimeter wall 212 can have the lip 252 on at least one of the heel portion 110, the toe portion 114, the rear end 106, or any combination of the described positions. The lip 252 includes a lip thickness 255 and a lip height 257. The lip thickness 255 and/or the lip height 257 can remain constant, or can vary from near the front 102 to near the rear end 106, or from near the heel portion 110 to near the toe portion 114 of the club head 100. In some embodiments, the lip 252 can contribute to increased perimeter weighting of the club head 100, resulting in increased club head moment of inertia and forgiveness.

Figure 9:
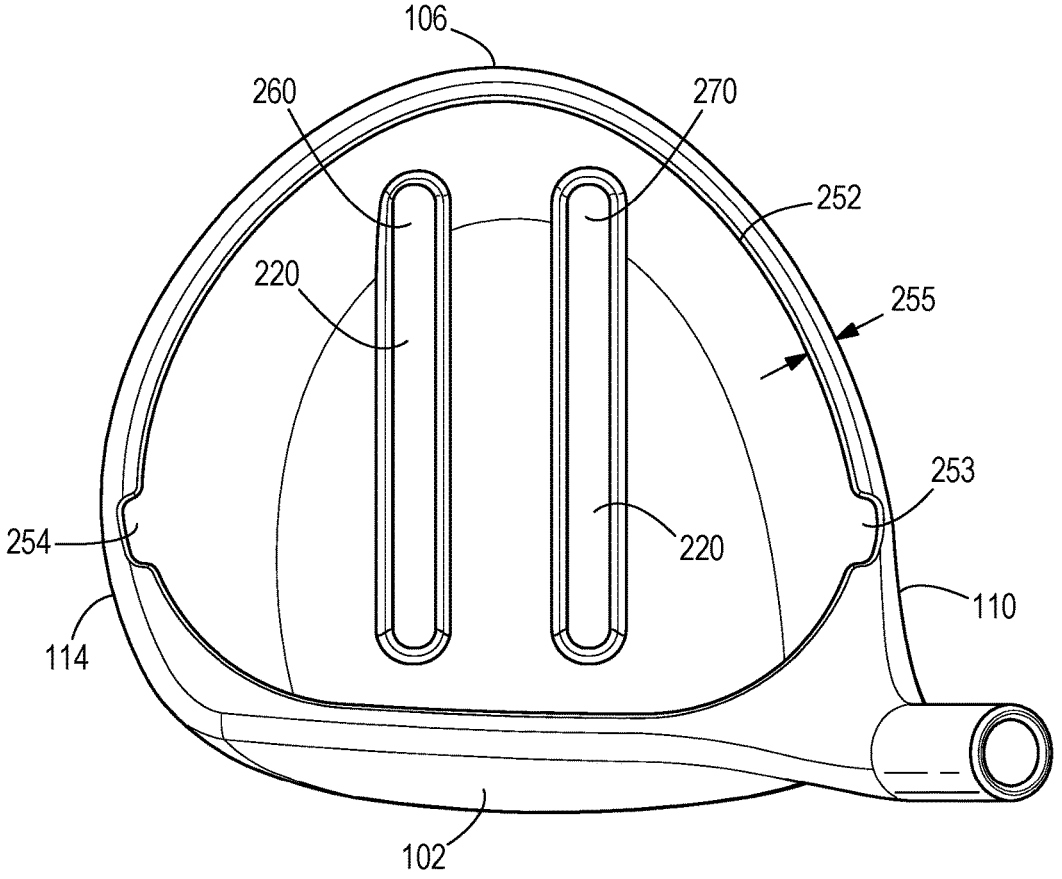
FIG. 9 illustrates a top view of another embodiment of a golf club head.

Referring to FIG. 9, in some embodiments, the perimeter wall 212 and/or lip 252 can define at least one recess or notch or void 253, 254. In many embodiments, the lip 252 and/or perimeter wall 212 can vary in thickness and/or in height to form the at least one recess 253, 254. For example, the lip 252 can vary in lip thickness 255 and/or lip height 257 to form the at least one recess 253, 254. For further example, the perimeter wall 212 can vary in perimeter wall thickness 248 and/or perimeter wall height 244 to form the at least one recess 253, 254. In the illustrated embodiment (FIG. 9), the lip 252 and perimeter wall 212 vary in lip thickness 255 and perimeter wall thickness 248, respectively, to form a first recess 253 between the front end 102 and the rear end 106 near the heel portion 110 and a second recess 254 between the front end 102 and the rear end 106 near the toe portion 114. In other embodiments, the lip 252 and perimeter wall 212 can vary in lip height 257 and perimeter wall height 244, respectively, to form a first recess 253 between the front end 102 and the rear end 106 near the heel portion 110 and a second recess 254 between the front end 102 and the rear end 106 near the toe portion 114.

Accordingly, the at least one recess 253, 254 is positioned in the lip 252 and/or perimeter wall 212. In these or other embodiments, the at least one recess can be positioned on the lip 252 and/or perimeter wall 212 between the front end 102 and rear end 106 near locations that experience high stress during impact with a golf ball. In many embodiments, the at least one recess is positioned on the lip 252 and/or perimeter wall 212 within 60% of the length 138 of the club head 100 from the front end 102. For example, the at least one recess can be positioned o the lip 252 and/or perimeter wall 212 within 10%, within 15%, within 20%, within 25%, within 30%, within 35%, within 40%, within 45%, within 50%, within 55%, or within 60% of the length 138 of the club head 100 from the front end 102.

The recess(es) 253, 254 can comprise any size and any shape. In the illustrated embodiment, the lip thickness 255 and the perimeter wall thickness 248 vary to form recesses that are substantially rectangular in shape. In other embodiments, the lip thickness 255, lip height, 257, perimeter wall thickness 248, and/or perimeter wall height 244 can vary according to any profile to form recesses having other shapes, such as square, triangular, circular, elliptical, or any other polygon or shape with at least one curved surface.

In these or other embodiments, the at least one recess can act as a stress relief on the club head 100 during impact with a golf ball. For example, the at least one recess can relieve stress on the perimeter wall 212 due to bending of the front end 102 of the club head 100 toward the perimeter wall 212 during impact. For further example, the at least one recess can direct the impact stress to the location of the recesses, and dissipate the stress from the club head 100, thereby increasing the impact force the club head 100 is capable of withstanding.

Referring to FIGS. 1-2, in many embodiments, the weight member or plurality of weight members 220 includes a first weight member 260. The first weight member 260 includes a first weight, a first volume, and a first weight member center of gravity (CG) 262. The first weight member 260 is positioned adjacent to the top surface 204 of the sole 118. In the illustrated embodiment, the first weight member 260 is positioned substantially equidistant between the heel portion 110 and the toe portion 114. In other embodiments, referring to FIG. 9, the first weight member 260 may be shifted closer to the heel portion 110 or closer to the toe portion 114 of the club head 100. For example, the first weight member 260 can have a greater portion of the first volume positioned toward the heel portion 110, or the first weight member 260 can have a greater portion of the first volume positioned toward the toe portion 114 of the club head 100.

Referring to FIG. 6, the first weight member CG 262 is positioned at a first weight member CG depth 264 measured from the front plane 1006 in the direction of the z-axis 1030. The first weight member CG depth 264 is greater than the head CG depth 156. Therefore, the head CG 146 is positioned closer to the rear end 106 of the club head 100, than the head CG of a similar club head without the first weight member 260.

In the illustrated embodiment, the first weight member CG depth 264 is approximately 3.0 inches (7.62 cm). In many embodiments, the first weight member CG depth 264 is approximately 2.0-3.5 inches (5.08-889 cm). In some embodiments, the first weight member CG depth 264 can be approximately 2.5-3.0 inches (6.35-7.62 cm). For example, the first weight member CG depth 264 can be approximately 2.0 inches (5.08 cm), approximately 2.25 inches (5.72 cm), approximately 2.5 inches (6.35 cm), approximately 2.75 inches (6.99 cm), approximately 3.0 inches (7.62 cm), approximately 3.25 inches (8.26 cm), or approximately 3.5 inches (8.89 cm).

The first weight member CG position can also be described relative to the length 138 of the club head 100. In many embodiments, the first weight member CG depth 264 is approximately 50-90% of the length 138 of the club head 100. In some embodiments, the first weight member CG depth 264 can be approximately 60-80% of the length 138 of the club head 100. For example, the first weight member CG depth 264 can be greater than approximately 50%, greater than approximately 55%, greater than approximately 60%, greater than approximately 65%, greater than approximately 70%, greater than approximately 75%, greater than approximately 80%, or greater than approximately 85% of the length 138 of the club head 100. In the illustrated embodiment, the first weight member CG depth 264 is approximately 77% of the length 138 of the club head 100.

The first weight member CG position can be further defined relative to the head CG 146 of the club head 100. In many embodiments, a first ratio of the first weight member CG depth 264 to the head CG depth 156 is approximately 1.0-3.5. In some embodiments, the first ratio of the first weight member CG depth 264 to the head CG depth 156 can be approximately 1.5-3.0. For example, the first ratio of the first weight member CG depth 264 to the head CG depth 156 can be greater than approximately 1.0, greater than approximately 1.5, greater than approximately 2.0, greater than approximately 2.5, or greater than approximately 3.0. In the illustrated embodiment, a first ratio of the first weight member CG depth 264 to the head CG depth 156 is approximately 2.3.

Referring to FIGS. 1-2, in the illustrated embodiment, the first weight member 260 is arcuate in shape and follows the curvature of the rear end 106 and/or perimeter wall 212 of the club head 100. In other embodiments referring to FIG. 9, the first weight member 260 can have any shape, such as circular, rectangular, ovular, or any other shape. For example, the first weight member 260 can be a polygon or shape with at least one curved surface. The apparatus, methods, and articles of manufacture as described herein are not limited in this regard.

Referring to FIG. 6, the first weight member 260 further includes a first weight member height 266 measured from the bottom surface 208 of the sole 118. In the illustrated embodiment, the first weight member height 266 is substantially constant. In other embodiments, the first weight member height 266 may vary. For example, the first weight member height 266 may increase in a direction from at least one of: the front end 102 to the rear end 106, the rear end 106 to the front end 102, the heel portion 110 to the toe portion 114, the toe portion 114 to the heel portion 110, or any combination of the above described directions.

In many embodiments, the first weight member height 266 can be approximately 0.05-0.30 inch (1.27-0.762 cm). In some embodiments, the first weight member height 266 can be approximately 0.10-0.20 inch (0.254-0.508 cm). For example, the first weight member height 266 can be approximately 0.05 inch (1.27 cm), approximately 0.10 inch (0.254 cm), approximately 0.15 inch (0.381 cm), approximately 0.20 inch (0.508 cm), approximately 0.25 inch (0.635 cm), or approximately 0.30 inch (0.762 cm). In the illustrated embodiment, the first weight member height 266 is approximately 0.15 inch (0.381 cm).

The first weight member 260 can comprise any material. In many embodiments, the first weight member 260 comprises the same material as the club head 100. For example, in some embodiments, the first weight member 260 comprises 17-4 stainless steel. For further example, in some embodiments, the first weight member 260 comprises H900 stainless steel. For further example still, the first weight member 260 can comprise any other material, such as a metal (e.g. titanium, steel, tungsten), a metal alloy (titanium alloy, steel alloy, stainless steel alloy, tungsten alloy), or a composite. In other embodiments, the first weight member 260 can comprise any material different than the material than the club head 100.

In some embodiments, the plurality of weight members 220 further includes a second weight member 270. The second weight member 270 includes a second weight, a second volume, and a second weight member center of gravity (CG) 272. The second weight member 270 is positioned adjacent to the top surface 204 of the sole 118. In the illustrated embodiment, the second weight member 270 is positioned substantially equidistant between the heel portion 110 and the toe portion 114. In other embodiments, referring to FIG. 9, the second weight member 270 may be shifted closer to the heel portion 110 or closer to the toe portion 114 of the club head 100. For example, the second weight member 270 can have a greater portion of the second volume positioned toward the heel portion 110, or the second weight member 270 can have a greater portion of the second volume positioned toward the toe portion 114 of the club head 100.

Referring to FIG. 6, the second weight member CG 272 is positioned at a second weight member CG depth 274 measured from the front plane 1006 in the direction of the z-axis 1030. The second weight member CG depth 274 is greater than the head CG depth 156. Therefore, the head CG 146 is positioned closer to the rear end 106 of the club head 100, than the head CG of a similar club head without the second weight member 270.

In the illustrated embodiment, the second weight member CG depth 274 is approximately 2.5 inches (6.35 cm). In many embodiments, the second weight member CG depth 274 is approximately 2.0-3.5 inches (5.08-8.89 cm). In some embodiments, the second weight member CG depth 274 can be approximately 2.5-3.0 inches (6.35-7.62 cm). For example, the second weight member CG depth 274 can be approximately 2.0 inches (5.08 cm), approximately 2.25 inches (5.72 cm), approximately 2.5 inches (6.35 cm), approximately 2.75 inches (6.99 cm), approximately 3.0 inches (7.62 cm), approximately 3.25 inches (8.26 cm), or approximately 3.5 inches (8.89 cm).

The position of the second weight member CG 272 can be further defined relative to the length 138 of the club head 100. In many embodiments, the second weight member CG depth 274 is approximately 50-90% of the length 138 of the club head 100. In some embodiments, the second weight member CG depth 274 can be approximately 60-80% of the length 138 of the club head 100. For example, the second weight member CG depth 274 can be greater than approximately 50%, greater than approximately 55%, greater than approximately 60%, greater than approximately 65%, greater than approximately 70%, greater than approximately 75%, greater than approximately 80%, or greater than approximately 85% of the length 138 of the club head 100. In the illustrated embodiment, the second weight member CG depth 274 is approximately 64% of the length 138 of the club head 100.

The position of the second weight member CG 272 can be further defined relative to the head CG 146 of the club head 100. In many embodiments, the second ratio of the second weight member CG depth 274 to the head CG depth 156 is approximately 1.0-3.5. In some embodiments, the second ratio of the second weight member CG depth 274 to the head CG depth 156 can be approximately 1.5-3.0. For example, the second ratio of the second weight member CG depth 274 to the head CG depth 156 can be greater than approximately 1.0, greater than approximately 1.5, greater than approximately 2.0, greater than approximately 2.5, or greater than approximately 3.0. In the illustrated embodiment, a second ratio of the second weight member CG depth 274 to the head CG depth 156 is approximately 1.9.

Referring to FIGS. 1-2, in the illustrated embodiment, the second weight member 270 is substantially circular in shape. In other embodiments, referring to FIG. 9, the second weight member 270 can have any shape, such as triangular, rectangular, ovular, or any other shape. For example, the second weight member 270 can be a polygon or shape with at least one curved surface. The apparatus, methods, and articles of manufacture as described herein are not limited in this regard.

Referring to FIG. 6, the second weight member 270 further includes a second weight member height 276 measured from the bottom surface 208 of the sole 118. In the illustrated embodiment, the second weight member height 276 is substantially constant. In other embodiments, the second weight member height 276 may vary. For example, the second weight member height 276 may increase in a direction from at least one of: the front end 102 to the rear end 106, the rear end 106 to the front end 102, the heel portion 110 to the toe portion 114, the toe portion 114 to the heel portion 110, or any combination of the above described directions.

In the illustrated embodiment, the second weight member height 276 is approximately 0.15 inch (0.381 cm). In many embodiments, the second weight member height 276 can be approximately 0.05-0.30 inch (1.27-0.762 cm). In some embodiments, the second weight member height 276 can be approximately 0.10-0.20 inch (0.254-0.508 cm). For example, the second weight member height 276 can be approximately 0.05 inch (0.127 cm), approximately 0.10 inch (0.254 cm), approximately 0.15 inch (0.381 cm), approximately 0.20 inch (0.508 cm), approximately 0.25 inch (0.635 cm), or approximately 0.30 inch (0.762 cm).

The second weight member 270 can comprise any material. In many embodiments, the second weight member 270 comprises the same material as the club head 100. For example, in some embodiments, the second weight member 270 comprises 17-4 stainless steel. For further example, in some embodiments, the second weight member 270 comprises H900 stainless steel. For further example still, the second weight member 270 can comprise any other material, such as a metal (e.g. titanium, steel, tungsten), a metal alloy (titanium alloy, steel alloy, stainless steel alloy, tungsten alloy), or a composite. In other embodiments, the second weight member 270 can comprise any material different than the material than the club head 100.

The weight member or plurality of weight members 220, as described herein, can increase the perimeter weighting of the club head 100, thereby increasing the moment of inertia of the club head 100 compared to a similar club head without a weight member. Increased perimeter weighting and moment of inertia can result in increased forgiveness of the club head 100. Further, the weight member or plurality of weight members 220, as described herein, shift the head CG 146 toward the rear end 106 and the sole 118 of the club head 100, thereby reducing backspin and increasing dynamic loft of the club head 100, resulting in increased ball speed and distance. Accordingly, the club head 100 having the weight member or plurality of weight members 220 described herein can have increased forgiveness for off center hits, and increased ball speed and distance, compared to a similar club head without a weight member or plurality of weight members.

In the illustrated embodiment, the weight members are formed integrally with the club head 100. In other embodiments, the weight members can be formed separately from the club head 100. In these embodiments, the weight members can subsequently be removably or permanently coupled to the club head 100.

A method of manufacturing the golf club head 100 is described herein. The method includes forming a club head 100 devoid of a crown, the club head 100 having a front end 102, a rear end 106 opposite the front end 102, a heel portion 110, a toe portion 114 opposite the heel portion 110, and a sole 118. Forming the club head 100, as described herein, includes forming the front end 102 having a strikeface 160 with a striking surface, a back surface 168, and a reinforcement element 180 positioned on the back surface 168. Forming the club head 100, as described herein, further includes forming the sole 118 with a sole transition thickness 232 and a weight member or plurality of weight members 220. The club head 100 may be formed using any process, such as casting, 3D printing, rapid prototyping, machining, or any other process.

In many embodiments, the club head 100 described herein is formed as a single piece construction. Specifically, the club head 100 is cast as a single piece including the front end 102 having the reinforcement element 180, the heel portion 110, the toe portion 114, and the sole 118 having the weight member or plurality of weight members 220. In these embodiments, the club head 100 can be formed as a single piece construction by casting, 3D printing, rapid prototyping, machining, or any other suitable method.

In other embodiments, the method of manufacturing the club head 100 can include additional or different steps. For example, in other embodiments, the club head 100 may be formed separately from the reinforcement element 180, the weight member 220, and/or the strikeface 160. In these embodiments, the reinforcement element 180, the weight member 220, and/or the strikeface 160 may be formed separately from the club head 100 body by casting, 3D printing, rapid prototyping, machining, or any other suitable method, and coupled to the body as a second operation. Other variations can be implemented for method without departing from the scope of the present disclosure.

Clause 1: A golf club head comprising: a front end having a bottom rail a top rail and a strikeface, the strikeface including a striking surface, a back surface, and a reinforcement element comprising a looped rib extending from the back surface of the strikeface, the looped rib having an outer perimeter surface and an inner perimeter surface, wherein the outer perimeter surface is filleted with the back surface of the strikeface and a largest rib span of the inner perimeter surface is approximately 0.609 cm to approximately 1.88 cm; a rear end opposite the front end; a heel portion; a toe portion opposite the heel potion; a sole coupled to the front end along the bottom rail at a sole transition region, the sole extending toward the rear end of the golf club head and including a sole thickness, at least one weight member, and a perimeter wall extending from the front end near the heel portion to the front end near the toe portion along the rear end of the club head, wherein the perimeter wall includes a perimeter wall thickness and a perimeter wall height that decreases from the front end toward the rear end of the club head, wherein the club head is devoid of a crown, and the back surface of the strikeface and a top surface of the sole are exposed.

Clause 2: The golf club head of clause 1, wherein the club head further includes a length measured as the greatest distance from a front plane to the rear end of the club head in a direction parallel to a ground plane, a height measured as the distance from the ground plane to a highest point of the front end of the club head in a direction perpendicular to the ground plane, and a center of gravity (CG) positioned at a head CG height from the ground plane and a head CG depth from the front plane, wherein the head CG height is less than 60% of the height of the club head, and the head CG depth is greater than 25% of the length of the club head.

Clause 3: The golf club head of clause 1, wherein the sole thickness is less than 0.060 inch (0.152 cm).

Clause 4: The golf club head of clause 1, wherein the sole transition region includes a sole transition thickness less than 0.060 inch (0.152 cm).

Clause 5: The golf club head of clause 1, wherein the sole transition region includes a radius of curvature between 0.010-0.040 inch (0.0254-0.102 cm).

Clause 6: The golf club head of clause 1, wherein the at least one weight member includes a first weight member, the first weight member comprising a first weight member center of gravity (CG) positioned at a first weight member CG depth, wherein the first weight member depth is greater than the head CG depth.

Clause 7: The golf club head of clause 6, wherein a first ratio of the first weight member CG depth to the head CG depth is greater than 1.5.

Clause 8: The golf club head of clause 1, wherein the at least one weight member further includes a second weight member, the second weight member comprising a second weight member center of gravity (CG) positioned at a second weight member CG depth, wherein the second weight member depth is greater than the head CG depth.

Clause 9: The golf club head of clause 8, wherein a second ratio of the second weight member CG depth to the head CG depth is greater than 1.5.

Clause 10: The golf club head of clause 1, wherein the perimeter wall includes a perimeter wall thickness between 0.020-0.060 inch (0.0508-0.152 cm).

Clause 11: The golf club head of clause 1, wherein at least one of the perimeter wall thickness or the perimeter wall height varies to form one or more recesses in the perimeter wall.

Clause 12: The golf club head of clause 11, wherein the one or more recesses are positioned along the perimeter wall between the front end and rear end of the club head.

Clause 13: The golf club head of clause 1, further comprising a lip that extends along the perimeter wall from the front end near the heel portion to the front end near the toe portion along the rear end of the club head.

Clause 14: The golf club head of claim 12, wherein the lip further comprises a lip thickness and a lip height, and at least one of the lip thickness or the lip height varies to form a one or more recesses in the lip.

Clause 15: A golf club comprising a shaft, a grip, and a club head including: a front end having a bottom rail a top rail and a strikeface, the strikeface including a striking surface, a back surface, and a reinforcement element comprising a looped rib extending from the back surface of the strikeface, the looped rib having an outer perimeter surface and an inner perimeter surface, wherein the outer perimeter surface is filleted with the back surface of the strikeface and a largest rib span of the inner perimeter surface is approximately 0.609 cm to approximately 1.88 cm; a rear end opposite the front end; a heel portion; a toe portion opposite the heel potion; a sole coupled to the front end along the bottom rail at a sole transition region, the sole extending toward the rear end of the golf club head and including a sole thickness, at least one weight member, and a perimeter wall extending from the front end near the heel portion to the front end near the toe portion along the rear end of the club head, wherein the perimeter wall includes a perimeter wall thickness and a perimeter wall height that decreases from the front end toward the rear end of the club head, wherein the club head is devoid of a crown, and the back surface of the strikeface and a top surface of the sole are exposed.

Clause 16: The golf club of clause 15, wherein the club head further includes a length measured as the greatest distance from a front plane to the rear end of the club head in a direction parallel to a ground plane, a height measured as the distance from the ground plane to a highest point of the front end of the club head in a direction perpendicular to the ground plane, and a center of gravity (CG) positioned at a head CG height from the ground plane and a head CG depth from the front plane, wherein the head CG height is less than 60% of the height of the club head, and the head CG depth is greater than 25% of the length of the club head.

Clause 17: The golf club of clause 15, wherein the at least one weight member includes a first weight member, the first weight member comprising a first weight member center of gravity (CG) positioned at a first weight member CG depth, wherein the first weight member depth is greater than the head CG depth.

Clause 18: The golf club of clause 15, wherein the at least one weight member further includes a second weight member, the second weight member comprising a second weight member center of gravity (CG) positioned at a second weight member CG depth, wherein the second weight member depth is greater than the head CG depth.

Clause 19: The golf club of clause 15, further comprising a lip that extends along the perimeter wall from the front end near the heel portion to the front end near the toe portion along the rear end of the club head.

Clause 20: A method of manufacturing a golf club head, comprising forming a club head devoid of a crown, the club head having a front end having a bottom rail a top rail and a strikeface, the strikeface including a striking surface, a back surface, and a reinforcement element comprising a looped rib extending from the back surface of the strikeface, the looped rib having an outer perimeter surface and an inner perimeter surface, wherein the outer perimeter surface is filleted with the back surface of the strikeface and a largest rib span of the inner perimeter surface is approximately 0.609 cm to approximately 1.88 cm; a rear end opposite the front end; a heel portion; a toe portion opposite the heel potion; a sole coupled to the front end along the bottom rail at a sole transition region, the sole extending toward the rear end of the golf club head and including a sole thickness, at least one weight member, and a perimeter wall extending from the front end near the heel portion to the front end near the toe portion along the rear end of the club head, wherein the perimeter wall includes a perimeter wall thickness and a perimeter wall height that decreases from the front end toward the rear end of the club head, wherein the club head is devoid of a crown.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising:

a front end having a bottom rail, a top rail, and a strikeface, the strikeface including:
- a striking surface;
- a back surface; and
- a reinforcement element comprising a looped rib extending from the back surface of the strikeface, the looped rib having an outer perimeter surface and an inner perimeter surface, wherein:
  - the outer perimeter surface is filleted with the back surface of the strikeface; and
  - a largest rib span of the inner perimeter surface is 0.609 cm to 1.88 cm;

a rear end opposite the front end;

a heel portion;

a toe portion opposite the heel potion;

a sole coupled to the front end along the bottom rail at a sole transition region, the sole extending toward the rear end of the golf club head and including:
- a sole thickness;
- a perimeter wall extending from the front end near the heel portion to the front end near the toe portion along the rear end of the club head, wherein the perimeter wall includes a perimeter wall thickness and a perimeter wall height that decreases from the front end toward the rear end of the club head; wherein, the club head is devoid of a crown; and the back surface of the strikeface and a top surface of the sole are exposed.

2. The golf club head of claim 1, wherein the club head further includes:

a length measured as a greatest distance from a front plane to the rear end of the club head in a direction parallel to a ground plane;

a height measured as a distance from the ground plane to a highest point of the front end of the club head in a direction perpendicular to the ground plane; and a center of gravity (CG) positioned at a head CG height from the ground plane and a head CG depth from the front plane; wherein, the head CG height is less than 60% of the height of the club head; and the head CG depth is greater than 25% of the length of the club head.

3. The golf club head of claim 2, wherein the club head further comprises at least one weight member, and the at least one weight member includes a first weight member, the first weight member comprising a first weight member center of gravity (CG) positioned at a first weight member CG depth, wherein the first weight member CG depth is greater than the head CG depth.

4. The golf club head of claim 3, wherein a ratio of the first weight member CG depth to the head CG depth is greater than 1.5.

5. The golf club head of claim 3, wherein the at least one weight member further includes a second weight member, the second weight member comprising a second weight member center of gravity (CG) positioned at a second weight member CG depth, wherein the second weight member CG depth is greater than the head CG depth.

6. The golf club head of claim 5, wherein a ratio of the second weight member CG depth to the head CG depth is greater than 1.5.

7. The golf club head of claim 1, wherein the sole thickness is less than 0.060 inch (0.152 cm).

8. The golf club head of claim 1, wherein the sole transition region includes a sole transition thickness less than 0.060 inch (0.152 cm).

9. The golf club head of claim 1, wherein the sole transition region includes a radius of curvature of the sole between 0.010-0.040 inch (0.0254-0.102 cm).

10. The golf club head of claim 1, wherein the perimeter wall thickness ranges from 0.020-0.060 inch (0.0508-0.152 cm).

11. The golf club head of claim 1, wherein at least one of the perimeter wall thickness or the perimeter wall height varies to form one or more recesses in the perimeter wall.

12. The golf club head of claim 11, wherein the one or more recesses are positioned along the perimeter wall between the front end and rear end of the club head.

13. The golf club head of claim 1, further comprising a lip that extends along the perimeter wall from the front end near the heel portion to the front end near the toe portion along the rear end of the club head.

14. The golf club head of claim 13, wherein the lip further comprises a lip thickness and a lip height, and at least one of the lip thickness or the lip height varies to form one or more recesses in the lip.

15. A method of manufacturing a golf club head, comprising:

forming a club head devoid of a crown, the club head having:

a front end having a bottom rail, a top rail, and a strikeface, the strikeface including:

a striking surface;

a back surface; and a reinforcement element comprising a looped rib extending from the back surface of the strikeface, the looped rib having an outer perimeter surface and an inner perimeter surface, wherein:

the outer perimeter surface is filleted with the back surface of the strikeface; and a largest rib span of the inner perimeter surface is 0.609 cm to 1.88 cm;

a rear end opposite the front end;

a heel portion;

a toe portion opposite the heel potion;

a sole coupled to the front end along the bottom rail at a sole transition region, the sole extending toward the rear end of the golf club head and including:

a sole thickness;

a perimeter wall extending from the front end near the heel portion to the front end near the toe portion along the rear end of the club head, wherein the perimeter wall includes a perimeter wall thickness and a perimeter wall height that decreases from the front end toward the rear end of the club head; wherein, the club head is devoid of a crown; and the back surface of the strikeface and a top surface of the sole are exposed.

* * * * *